United States Patent [19]

Wilhelm

[11] 4,288,026

[45] Sep. 8, 1981

[54] CONTAINER STRUCTURE

[75] Inventor: Thomas D. Wilhelm, Larsen, Wis.

[73] Assignee: American Can Company, Greenwich, Conn.

[21] Appl. No.: 72,911

[22] Filed: Sep. 6, 1979

[51] Int. Cl.[1] ..... B65D 3/04; B32B 23/08

[52] U.S. Cl. ..... 229/1.5 B; 229/4.5

[58] Field of Search ..... 229/1.5 B, 4.5

[56] References Cited

U.S. PATENT DOCUMENTS

| | | | |
|---|---|---|---|
| 2,917,217 | 12/1959 | Sisson | 229/4.5 |
| 3,049,277 | 8/1962 | Shappell | 229/1.5 B |
| 3,333,515 | 8/1967 | McGlynn | 229/1.5 B X |
| 3,754,699 | 8/1973 | Moore | 229/1.5 B |
| 3,759,437 | 9/1973 | Amberg | 229/1.5 B |
| 3,988,521 | 10/1976 | Fumel et al. | 229/1.5 B X |
| 4,130,234 | 12/1978 | Schmidt | 229/1.5 B |

*Primary Examiner*—Davis T. Moorhead

*Attorney, Agent, or Firm*—Robert P. Auber; George P. Ziehmer; Harry W. Hargis, III

[57] ABSTRACT

A container comprises a sidewall portion of generally circular cross-sectional configuration extending from a closed end portion to an open end portion. The container is of molded expanded polystyrene having a density of from about 1.0 to about 15 lbs./ft$^3$, and a thickness of from about 35 to about 100 mils. A reinforcing band encircling the sidewall portion and firmly adherent thereto comprises paper of from about 1 to about 2 mils thick, and having a basis weight of from about 9 to about 20 lbs./ream.

8 Claims, 7 Drawing Figures

CONTAINER STRUCTURE

BACKGROUND OF THE INVENTION

This invention relates to containers, and, more particularly, to improvements in foamed plastic cup structure for holding liquids.

Foam cups have been molded with considerable success from plastic materials, such as, for example, foamed or expanded polystyrene. Care has to be taken, however, to ensure adequate strength and rigidity of a cup, particularly when holding hot liquids. Efforts directed to controlling strength and rigidity of a cup have involved, variously, increasing the density of the polystyrene foam and use of composite structures including paper and plastics in addition to the foam. These techniques, while having the desired effect, add to the cost of the cup due to the excessive use of additional materials. An additional disadvantage of molded cups has been the high cost and poor quality of decoration. Conventional methods include post-printing and a combination of post-printing and embossing, and neither method provides a highly attractive finished product.

By way of example, a typical 8 fluid ounce polystyrene foam cup uses about 2.25 grams of foam at a density of 4 lbs./ft$^3$. An improved cup of the known art uses about 2.8 grams of foam at a density of about 6 lbs./ft$^3$. Still another improved cup of the conventional art uses about 3 to about 4 grams of foam at about 9 lbs./ft$^3$. While the improved prior-art cups exhibit improved strength and rigidity, there is a disadvantageous cost penalty imposed by the substantial increases in material usage. A further disadvantage is that the insulation values of the improved cups are reduced by the increased foam density taken with correspondingly reduced wall thicknesses. None of these improvements takes into account the subject of improved product decoration.

Another 8 ounce cup typical of the prior art is constructed from a laminate of polystyrene foam and paperboard. The foam is about 8 mils thick, 12 lbs./ft$^3$ density, the paperboard is about 10.5 mils thick, 107 lbs./ream, and the overall weight of the cup is about 12 grams. It will be apparent to those skilled in the art that such a structure is essentially a conventional "paper cup" provided with a thin layer of thermally insulating foam as an inner liner. As such, it exhibits many of the typical properties of paper cups. Thus it is easily printed for attractiveness, and uses large quantities of material, making it expensive, the use of a foam liner adding further to typical costs of a paper cup. Interestingly, conventional paper cups (even without a foam liner) are no longer cost competitive for many end uses, and adding a thin layer of foam without gaining significant structural advantages has been found to be prohibitively expensive. Further, the foam thickness and density combined into this cup provide insufficient thermal insulation to enable the user to comfortably hold the cup with a hot liquid in it—another problem typically encountered with paper cups.

The following U.S. Pat. Nos. are representative of the prior art, and are believed material to the examination of this application:

3,754,699 discloses an expanded polystyrene container 10 having a pressure-sensitive, adhesive-backed, narrow reinforcing band 20 disposed adjacent its upper peripheral edge.

3,988,521 discloses a cup 10 comprising foamed polystyrene layer 21 provided with a paper outer layer 20 joined thereto by an adhesive layer 22.

3,333,515 discloses a cup 23 formed from a body blank comprising a laminated web 10 made up of a paper web 11 and a foamed plastic web 12.

3,049,277 discloses a cup 10 provided with an inner paper body 11 lined with a liquid impervious layer such as foamed polystyrene, and an outer band 18 of foamed polystyrene.

2,917,217 discloses a container formed from a laminate sheet of foamed polystyrene and paper, and bearing thereupon printed designs and lettering.

It is an objective of the present invention to provide an improved cup structure comprising a foamed plastic body provided with a reinforcing band, which structure is characterized by its efficient utilization of materials to provide strength and rigidity.

It is a further objective of the invention to provide a foamed plastic cup structure characterized by its improved strength, rigidity, economy of manufacture, and economy of material usage.

It is also an object to provide such a cup having excellent insulating properties and the capability of being decorated using conventional high quality, high speed continuous web printing techniques.

SUMMARY OF THE INVENTION

In achievement of the foregoing, as well as other objectives and advantages, the invention contemplates a molded container comprising: a sidewall portion of generally circular cross-sectional configuration extending from a closed end portion to an open end portion thereof, said sidewall and said closed end portions being of expanded polystyrene having a density of from about 1.0 to about 15 lbs./ft$^3$ and a thickness of from about 35 to about 100 mils; and a band encircling said sidewall portion and firmly adherent thereto, said band comprising lightweight, highly flexible paper of from about 1 to about 2 mils thick and having a basis weight of from about 9 to about 20 lbs./ream.

The manner in which the foregoing as well as other objectives and advantages of the invention may best be achieved will be more fully understood from a consideration of the following description, taken in light of the accompanying drawing.

DESCRIPTION OF THE SEVERAL EMBODIMENTS OF THE INVENTION

Figure 1:
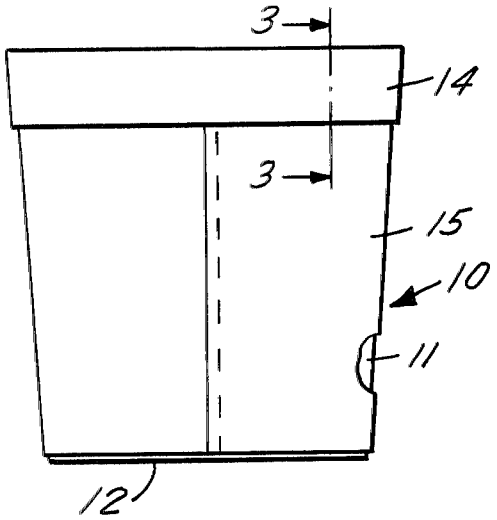
FIG. 1 is a side elevational view of a cup embodying the invention.
Figure 3:
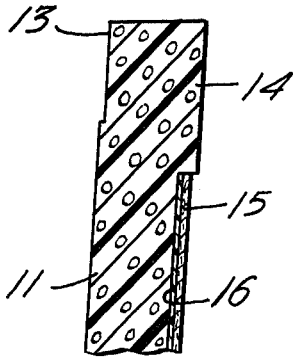
FIG. 3 is an enlarged fragmentary sectional view taken along the line 3—3 in FIG. 1, and looking in the direction of arrows applied thereto.
Figure 2:
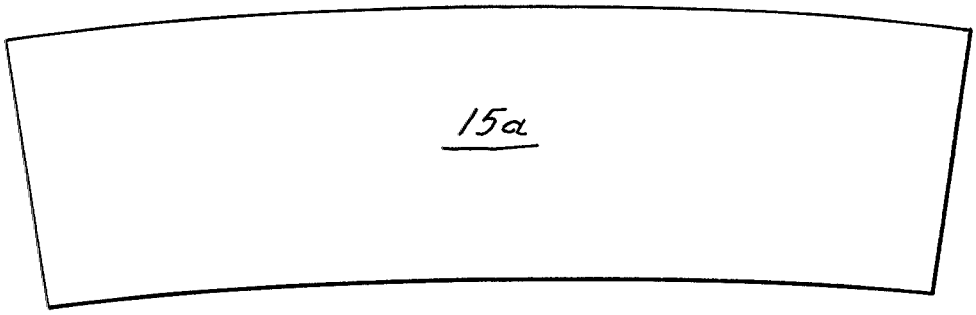
FIG. 2 is a plan view of a blank used in the cup structure.

With more detailed reference to the drawing, and first to FIG. 1, a cup 10 embodying a preferred form of the invention comprises sidewall portion 11 and closed end portion 12 integrally molded from expanded or foamed polystyrene. Sidewall portion 11 is of generally circular cross-sectional shape and extends in a taper from closed end portion 12 to an open end portion 13. A lip portion 14 is disposed exteriorly of portion 13, and a sleeve or band of paper 15 is firmly adherent throughout a substantially circumferential band region of the outer surface of sidewall portion 11. Preferably, and with reference also to FIG. 2, the band of paper 15 is first formed from a blank 15*a* of suitable shape, and disposed about tapered sidewall portion 11 with an intermediate layer of adhesive 16. Disposition of the band 15 about sidewall 11 may be effected by wrapping blank 15*a* onto wall 11 and adhering it thereto.

Considering the structure of cup 10 in more detail, the sidewall 11 and bottom 12 are integrally molded in a suitably shaped mold to a wall thickness of from about 35 to about 100 mils, by expanding from about 0.7 to about 10.0 grams of polystyrene beads to a density of from about 1.0 to about 15 lbs./ft.$^3$ and molding therefrom in known manner, a one-piece, seamless cup having a nominal liquid holding capacity of about 8 fluid ounces.

In application of band 15, a cup 10 is held on a rotatable mandrel (not shown) while a paper band blank 15*a* with applied adhesive is held flat on a vacuum chuck. The mandrel and cup are then rotated, while the vacuum chuck is moved to apply the paper blank along a line to the rotating cup. Substantially simultaneously with the line application, the paper is pulled from the vacuum chuck. Just prior to application of the paper blank, the hot melt adhesive has been heated to about 200° F. to render it tacky so that the paper blank will adhere and wrap onto the cup in formation of a reinforcing band, as the cup is rotated. Since the hot melt adhesive is fast setting, and the band cools and sets rapidly after application, the banded or sleeved cup is complete when it is removed from the mandrel.

For the lighter foam densities, such as, for example, 6 lbs./ft.$^3$ or less, those skilled in the art will appreciate that the adhesive is well insulated by the thermally effective layer of foam from the extreme temperatures exhibited by hot liquids commonly used in cups. The adhesive therefore is not subjected to temperature extremes, and any of a number of conventional adhesives will function satisfactorily.

A typical hot melt adhesive 16 is formulated from about 30% ethylene vinyl acetate (available from DuPont under the trade name Elvax 251), about 10% styrene tackifier (available from Hercules under the trade name Picotex-120), and about 60% wax (available from Bareco under the trade name Bareco 190–195), wherein the percentages are by weight. It will be appreciated by those skilled in the art that other adhesives, which may or may not be hot melt adhesives, may be selected depending on the thermal insulating effectiveness of the foam, so long as they provide good adhesion between the foam and the band. The hot melt adhesive is applied as a very thin layer to the entire surface of a band 15, using known techniques, and is solidified. The adhesive layer thickness is from about 4.5 to about 6 lbs./ream, preferably about 5 lbs./ream.

Cups embodying the invention have exhibited unexpectedly improved resistance to squeezing, both when filled with hot or cold liquids and when empty, as compared with cups formed from like materials but dimensioned in accordance with teachings of the prior art. Paper suitable for the band is from about 1 to about 2 mils thick, and has a basis weight from about 9 to about 20 lbs./3000 ft.$^2$ ream. Of particular note is the fact that bands of paper having basis weights as high as 40 lbs./ream were found to afford no more strength than bands of paper within the disclosed preferred low economical range of between about 9 and 20 lbs./ream. Thus it is seen that, contrary to expectation, the squeezing strength of the cup is substantially independent of the band basis weight in the range between 9 lbs./ream and 40 lbs./ream.

Figure 7:
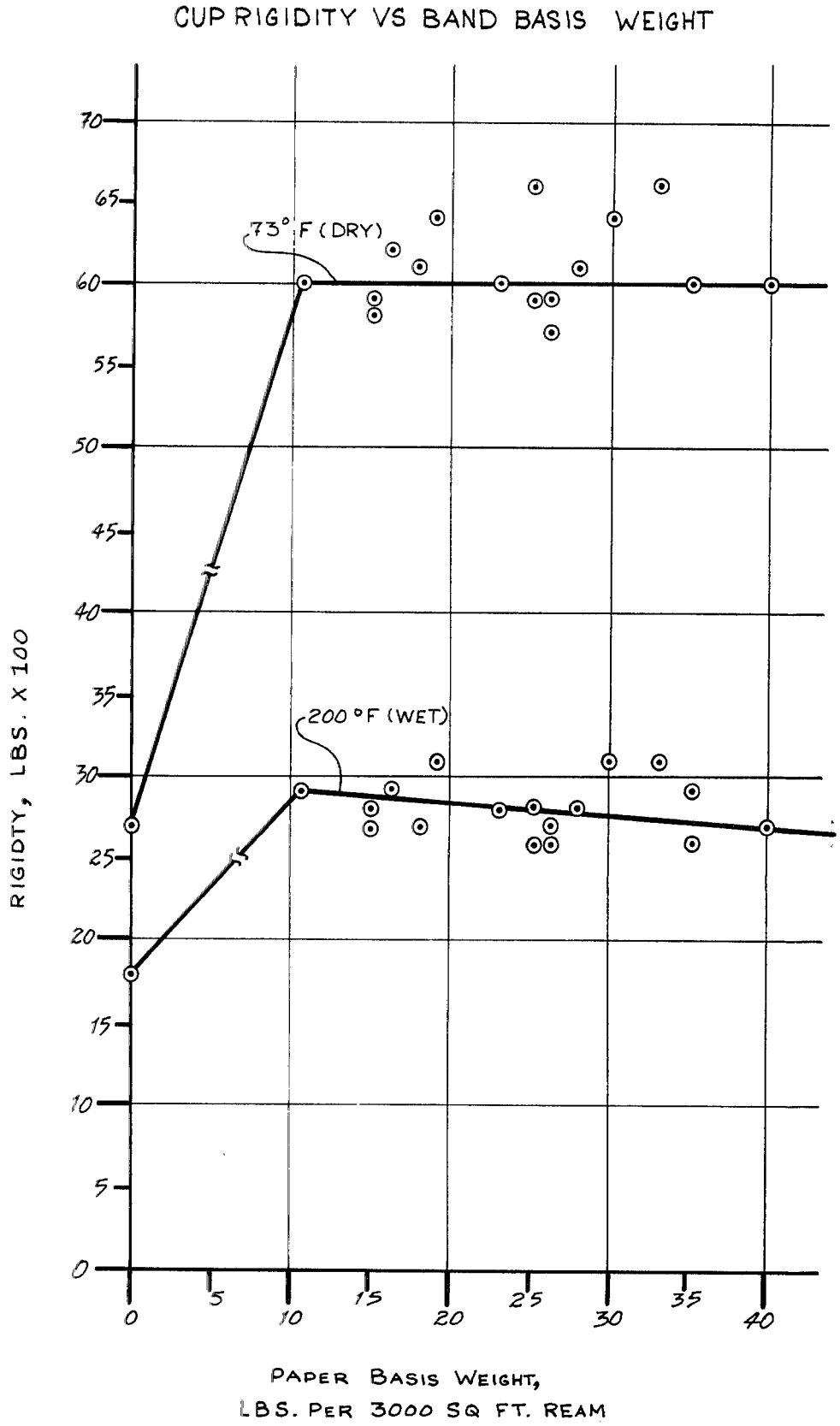
FIG. 7 is a graphical representation of the improved dry and wet cup rigidity achieved by bands of paper having basis weights contemplated by the invention.

The data in Table 1 shows the rigidity of cups with bands having a basis weight range of from 10.75 lbs./ream to 40 lbs./ream, compared to identical cups without a band. FIG. 7 shows the same data in the graphical format of rigidity as a function of paper band basis weight. As used throughout this description rigidity is expressed in LBS. × 100. The cup on a level surface, with a point just below the brim in contact with a constraining member, had a diametrically opposed point deflected ¼". The data clearly show a rigidity increase contributed by the band of about 60 percent filled with water at 200° F. (wet) and 122 percent while empty at 73° F. (dry), both increases based on the rigidity of the unbanded cup. Of greater significance are the graphical illustrations in FIG. 7 which indicate that the rigidity of the cup is surprisingly independent of the basis weight of the paper band in the range of 10.75 to 40 lbs./ream.

TABLE 1

Cup Rigidity* As a Function of Basis Weight of the Paper Band

| Paper Basis Weight | RIGIDITY, LBS. × 100 73° F. Dry | 200° F. wet |
|---|---|---|
| 0 | 27 | 18 |
| 10.75 | 60 | 29 |
| 15 | 58 | 27 |
| 15 | 59 | 28 |
| 16.25 | 62 | 29 |
| 18 | 61 | 27 |
| 19 | 64 | 31 |
| 23 | 60 | 28 |
| 25 | 59 | 26 |
| 25 | 66 | 28 |
| 26 | 57 | 26 |
| 26 | 59 | 27 |
| 28 | 61 | 28 |
| 30 | 64 | 31 |
| 33 | 66 | 31 |
| 35 | 60 | 26 |
| 35 | 60 | 29 |
| 40 | 60 | 27 |

*Cups were 1.05 grams foam weight, 7 fluid ounce capacity, 85 mil wall thickness.

For reasons of economy and resource preservation, the lighter weight band is, of course, desired. Through extensive testing, it has been found that this principle of using a lightweight, highly flexible reinforcing band can be effectively applied to cups having a wide range of foam body parameters, as disclosed above. The parameters of a preferred cup for a given product requirement will be determined by cost, ease of manufacture, and desired performance characteristics.

A preferred cup has a molded polystyrene foam body. Expandable polystyrene beads are pre-expanded in a conventional manner to the desired foam density. The pre-expanded beads are then filled into a suitable mold and heated, further expanding and fusing the foam beads to form a unitary or one-piece molded cup structure. The cup is then cooled and demolded. The reinforcing band is then applied in the manner described herein.

The following is a preferred set of parameters for an 8 fluid ounce cup using our structure: a foam density of about 1.7 lbs./ft$^3$; a wall thickness of about 95 mils; a foam weight of about 1.25 gms.; and a paper band or sleeve about 1 mil thick having a basis weight of about 10.75 lbs./ream. Foam density as used herein is the density of the pre-expanded foam beads before being placed in the mold.

It will be noted that both the amount of foam and the amount of paper have been substantially reduced by comparison to the parameters given in the prior art, while retaining rigidity equivalent to that of typical expanded polystyrene foam cups of the prior art. In another test comparison, 8 fluid ounce prior art cups were made with 50 mil walls, 4 lbs./ft$^3$ density foam, and banded with 30 lbs./ream. paper. These cups weighed 2.25 grams and had a rigidity value of 27 as compared to a rigidity value of 34 for 8 fluid ounce cups of this invention. Those cups had 95 mil walls, 1.7 lbs./ft$^3$ density foam, and 10.75 lbs./ream paper band, using 1.25 grams of foam material. In general, it has been found that the addition of the band has increased the rigidity of a foam cup by as much as about 100%. Thus, with the band in place, an equivalent rigidity is obtained with less foam material. By comparison with the typical 8 ounce cup described in the prior art, the foam material savings is:

$$\frac{2.25 \text{ grams} - 1.25 \text{ grams}}{2.25 \text{ grams}} \times 100 = 44\% \text{ weight savings of foamed plastic.}$$

Figure 4:
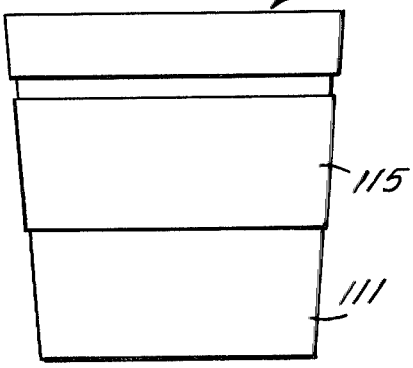
FIGS. 4, 5, and 6 are views similar to FIG. 1, and illustrating modified embodiments of the invention.
Figure 5:
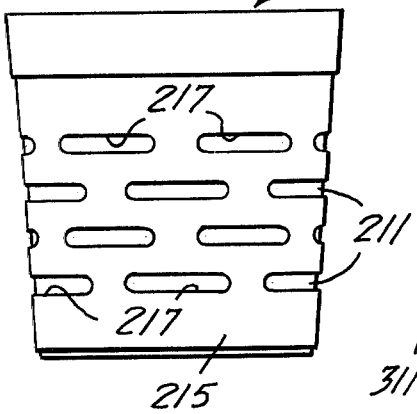
Figure 6:
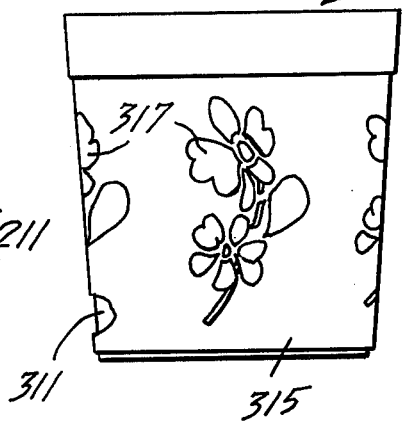

In any of the embodiments, the material of the band can first be printed for decorative purposes. This is indeed an improvement, as decorated foam cups have heretofore been post-printed directly on the foam after cup forming. The quality of that decoration has been poor, and the cost high. In our structure, the quality is high and the cost low, because of the greater ease and speed of printing on paper. As is seen in FIGS. 4, 5 and 6, the bands for cups 110, 210 and 310, as seen at 115, 215 and 315 on respective sidewalls 111, 211 and 311, may be formed, variously, as a band 115 extending less than the length or height of the container sidewall, as a band 215 extending the length of the container sidewall and including openings or perforations 217, or may be a full length band 315 provided with a decorative pattern 317. Conveniently, pattern 317 may comprise openings in the band, may be printed thereon, or may comprise a combination of open and printed pattern elements. In forming any of the bands, care is taken to insure that at least continuous sections thereof substantially encircle and are firmly adhered to all segments of the cup sidewall, in provision of the desired reinforcement.

The process parameters useful in making quality cup bodies will be obvious to those skilled in the art. What is most important for the cup body is that the structure is within the parameters previously described. The advantageous end result of substantial reinforcement by a lightweight, highly flexible paper band is substantially the same.

While preferred embodiments of the invention have been described and illustrated, it will be understood that other modifications may be made without departing from the scope of the appended claims.

We claim:

1. A container comprising: a sidewall portion of generally circular cross-sectional configuration and extending from a closed end portion to an open end portion thereof, said sidewall and said closed end portions being of seamless one-piece expanded polystyrene construction having a density of from about 1.5 to about 2.5 lbs./ft$^3$, and having a thickness of from about 70 to about 100 mils; and a reinforcing band encircling said sidewall portion and firmly adherent thereto throughout a substantially circumferential band region thereof, said band comprising paper of from about 1 to about 2 mils thick and having a basis weight of from about 9 to about 20 lbs./ream.

2. A container according to claim 1 wherein said band comprises paper of from about 1 to about 1½ mils thick having a basis weight of from about 9 to about 15 lbs./ream.

3. A container according to claim 1, wherein said sidewall and said closed end portions are of expanded polystyrene having a density of about 1.7 lbs./ft$^3$, at least said sidewall has a thickness of about 95 mils, and said band of paper has a basis weight of about 10.75 lbs./ream and a thickness of about 1 mil.

4. A container according to claim 1, wherein said band extends substantially the length of said sidewall portion.

5. A container according to claim 1 or 4, wherein said band is made adherent to said sidewall by the inclusion of a layer of hot melt adhesive between said band and said sidewall.

6. A container according to claim 1 or 4, wherein said band includes at least one circumferential row of perforations and at least one continuous section adjacent thereto and completely encircling said sidewall.

7. A container according to claim 5, wherein said hot melt adhesive is applied in a layer of from about 4.5 to about 6 lbs./ream.

8. A container according to claim 7, wherein said adhesive is applied in layer of about 5 lbs./ream.

* * * * *